United States Patent [19]

Higuchi et al.

[11] 4,177,974

[45] Dec. 11, 1979

[54] MOLTEN SLAG RUNNER FOR BLAST-FURNACE PLANT

[75] Inventors: Masaaki Higuchi; Genji Nakatani; Haruo Ito; Masamichi Matsuda, all of Fukuyama; Yoshinori Suetake, Kasaoka, all of Japan

[73] Assignee: Nippon Kokan Kabushiki Kaisha, Tokyo, Japan

[21] Appl. No.: 932,503

[22] Filed: Aug. 10, 1978

[30] Foreign Application Priority Data

Aug. 17, 1977 [JP] Japan ..... 52-97825

[51] Int. Cl.[2] ..... C21B 7/14

[52] U.S. Cl. ..... 266/196; 266/236

[58] Field of Search ..... 266/195, 196, 236, 191, 266/231; 75/24; 65/19, 20, 141

[56] References Cited

U.S. PATENT DOCUMENTS 1,881,228 10/1932 Pape ..... 266/196

3,198,616 8/1965 Havens ..... 266/236 X

FOREIGN PATENT DOCUMENTS 1244213 7/1967 Fed. Rep. of Germany .

2428590 12/1975 Fed. Rep. of Germany .

*Primary Examiner*—M. J. Andrews

*Attorney, Agent, or Firm*—Haseltine, Lake & Waters

[57] ABSTRACT

A runner extending from a blast furnace to a slag pit, water spray unit for manufacturing granulated slag or slag ladle is partly or wholly composed of a plurality of trough elements each made from copper or copper alloy. Each trough element comprises a hollow body having an inner space which is divided into sections by a plurality of partitions to define throughout the inner space of the body a series of passages in which a cooling medium is allowed to flow without stagnation. The cooling medium within the hollow body of the trough element is introduced under a predetermined pressure from a pipe line for supplying cooling medium into the body, whereby the cooling medium freely flows at a relatively high velocity in the passages defined by the partitions and molten slag glowing in contact with the surface of the trough element is cooled to a desired temperature which prevents wear and loss of the element and makes it possible to produce hard granulated slag from the molten slag.

4 Claims, 9 Drawing Figures

MOLTEN SLAG RUNNER FOR BLAST-FURNACE PLANT

BACKGROUND OF THE INVENTION

The present invention relates to molten slag runners for blast-furnace plants, and more particularly the invention relates to a molten slag runner comprising forced-cooling copper or copper alloy trough elements and designed so that the molten slag flowing from a blast furnace and separated from the molten iron is introduced into a slag pit, such as, a dry pit or water pit, water jet spray unit for the manufacture of granulated slag or molten slag ladle.

In the past, the prior art molten slag runners for blast-furnace plants have generally consisted of a trough constructed by stamping formless refractory material. The runner of this type is disadvantageous in that the molten slag sticks to the inner wall of the trough made from refractory material thus causing damage or wear of the coating laid over the refractory material, and particularly such damage or wear will be particularly great in the bent portions as well as the terminal end portions of the runner where the effect of the kinetic energy of the molten slag stream is so great and the heat load is also increased greatly. While such damaged or worn-out portions must be repaired by stamping formless refractory material, such repair work must be carried out in a high temperature atmosphere where not only some danger is involved but also the efficiency of the work is low. These deficiencies have come to be recognized as serious problems in the light of the recent tendency toward larger blast furnaces with the resulting increase in the flow rate of slag in the runners, and there has existed the need to overcome these deficiencies. Another disadvantage of the slag runner consisting of a trough made of refractory material is that it is difficult to subject the molten slag to force cooling thus causing difficulties in reducing the temperature of the molten slag to a desired level and processing the slag to produce a hard granulated slag product.

In other words, as one of the specific uses of the molten slag from a blast furnace, it is well known in the art to convert the molten slag into a hard granulated slag product having a large weight per unit volume and to use it in slag cements or concrete units as a replacement for sand. In the manufacture of such granulated slag by a granulation method employing water, the most effective way of increasing the weight per unit volume and the hardness of the granulated slag is to decrease the temperature of the raw material or molten slag and then effect the granulation. However, where the molten slag from a blast furnace is directly continuously subjected to water granulation, in the case of a molten slag runner consisting of a trough made of refractory material, it is impossible to regulate and control so that the temperature of the molten slag is forcibly reduced to a desired level prior to the granulation. With this type of molten slag runner consisting of a trough made of refractory material, the temperature of the molten slag outflowing from the runner end is usually relatively high ranging from 1,470° to 1,520° C. with the result that even if the pressure and quantity of water jets for the water granulation of the molten slag are increased, the maximum possible weight per unit volume of the resulting granulated slag will be on the order of 1.3 Kg/l and it will be extremely difficult to produce stably a product having a greater value of Kg/l.

While a solid addition agent may be added as a cooling agent to the molten slag as a method of cooling the molten slag prior to the granulation, it is still difficult for this method to ensure a continuous temperature control for the continuous stream of the molten slag, and moreover additional provisions for introducing such cooling agent must be made above the slag runner thus upsetting the arrangement of the units around the blast furnace. Further, while the installation of a cooling hose inside the refractory trough may be proposed as a means of cooling the molten slag, inferior heat conduction of the refractory material constituting the trough results in poor response of the control for cooling and its use in practical applications is extremely difficult.

SUMMARY OF THE INVENTION

It is a primary object of the invention to prevent particularly the occurrence of damage and wear in the bent portions as well as the terminal end portions of a runner through which molten slag flows from a blast furnace, thus ensuring longer service life for the runner.

It is another object of the invention to reduce the frequency of the work of repairing such a runner in a high temperature atmosphere and also to ensure a saving of the refractory material used.

It is still another object of the invention to improve the physical properties of granulated or air-cooled slag produced from molten slag, thus making it possible to effectively produce slag products having greater added values.

In accordance with an embodiment of the invention, a molten slag runner extending from a blast furnace to a slag pit, water jet unit for producing granulated slag or slag ladle is partly or wholly composed of a plurality of trough elements each made of copper or copper alloy and including a hollow body having an inner space which is divided into sections by a plurality of partitions to define throughout the inner space of the body a series of passages in which a cooling medium flows without stagnation.

The cooling medium, e.g., water in the water space of the trough element hollow body is introduced under a predetermined pressure from a pipe line for supplying the cooling medium to the body, and the water flows freely at a relatively high speed through the passages defined by the plurality of partitions, whereby the molten slag flowing in contact with the surface of the trough element is cooled to a desired temperature. In this cooling, the fact that the trough element is made of copper or copper alloy ensures very rapid response of the cooling rate to a change in the flow rate of the cooling water, with the result that by controlling the cooling water supply system, it is possible to stably and easily effect the desired cooling control for preventing melting loss of the trough element as well as the desired cooling control so that the produced granulated slag has a weight per unit volume which is greater than a predetermined value.

While the molten slag runner in accordance with the invention may be extensively used with the ordinary blast-furnace plants or equipment, particularly where the molten slag runner is used so that the molten slag outflowing from the tapping hole of a blast furnace and separated from the molten iron through the slag skimmer is directly supplied continuously to a water granulating plant, a gate including an outlet with a predetermined opening area should preferably be mounted in the molten slag runner downstream of the skimmer so as to prevent a change in the flow rate of the molten slag flowing toward the end of the runner and thereby to ensure greater uniformity of the properties of the granulated slag product.

Other objects and advantages of the invention will become more apparent from the following detailed description taken in conjunction with the accompanying drawings.

DESCRIPTION OF THE PREFERRED EMBODIMENTS

Figure 1:
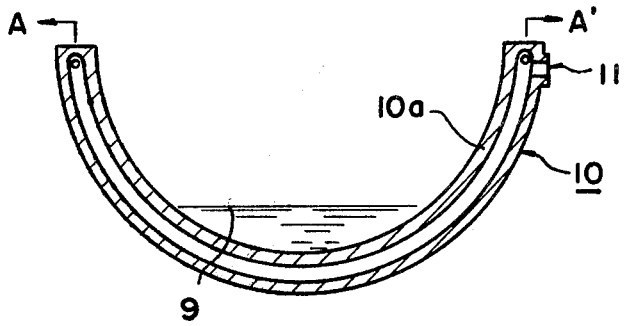
FIG. 1 is a cross-sectional view showing an embodiment of a trough element used to constitute a molten slag runner according to the invention.
Figure 2:
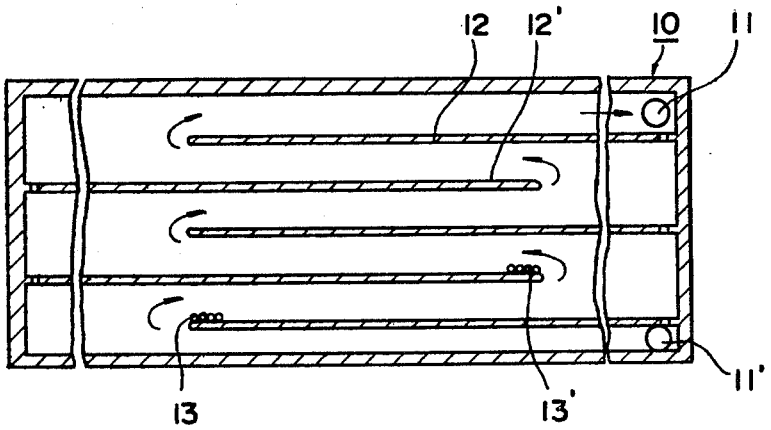
FIG. 2 is a developed sectional view of the trough element seen in the direction of the arrow A–A' in FIG. 1.

Referring now to FIGS. 1 and 2, numeral 10 designates a trough element composed of a unitary hollow body 10*a* made of copper or copper alloy and substantially semicircular in cross-sectional shape. The hollow body 10*a* is provided in one upper side edge portion with an exhaust port 11 and an inlet port 11' which are communicated with the hollow space within the body, and disposed in the hollow space within the hollow body are a plurality of partitions 12 and 12' which are alternately extended from the sides of the inner space to define a series of zigzag passages each having a relatively narrow cross-sectional passage area and arranged so that the direction of flow of cooling water flowing therethrough is perpendicular to the direction of flow of molten slag 9. This alternate arrangement of the partitions 12 and 12' has the effect of reducing the cross-sectional area of the cooling water passages in those portions corresponding to the trough bottom which will be brought into contact with the high temperature molten slag and subjected to the most severe heat load, thus increasing the flow velocity of the cooling water in the bottom portion and also preventing any stagnation of the cooling water. On the other hand, the cross-sectional area of the cooling water passages is made relatively large in the upper side portions where the heat load is not so large, with the result that the pressure loss of the cooling water is reduced and the occurrence of turbulent flows 13 and 13' which might be caused by a sudden change in the flow direction is limited to those locations which are remote from the trough bottom portion subjected to the most severe heat load, thus preventing melting loss of the trough element.

The length of this trough element may for example be on the order of 500 mm to ensure easy transportation and handling for installation or replacement.

Figure 3:
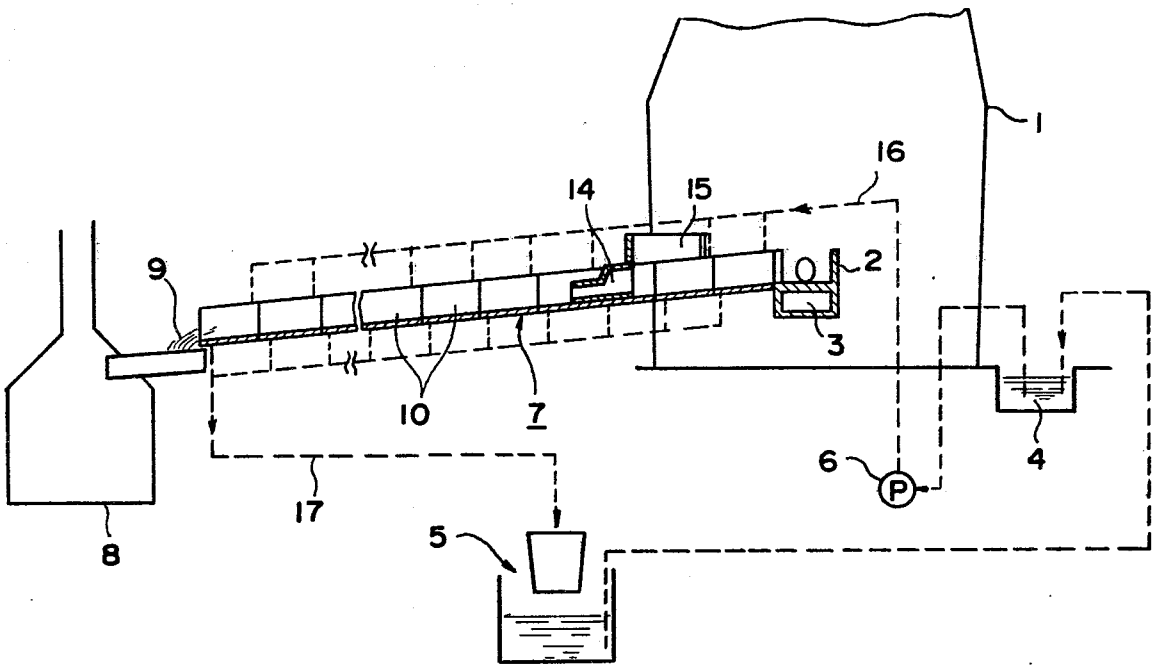
FIG. 3 is a flow diagram showing, along with a slag granulating plant, a molten slag runner according to an embodiment of the invention composed of the trough elements of FIG. 1.

FIG. 3 is a flow diagram showing a molten slag runner composed of a plurality of the above-mentioned trough elements together with a water jet slag granulating plant. In the Figure, numeral 1 designates a blast furnace, 2 a slag skimmer for separating the stream of molten metal from the tapping hole of the blast furnace into the slag and the iron, 3 a runner through which the stream of molten iron from the skimmer 2 flows, 4 a bottom water collecting pit, 5 a cooling tower for cooling water, 6 a feed water pump, 7 a molten slag runner composed of ten units of the trough element 10 connected in a line, 8 an agitation tank for water granulation, 9 molten slag which is to be mixed with water and granulated, 14 a gate with an outlet of a fixed opening cross-sectional area for maintaining constant and preventing variation in the flow rate of the molten slag to the agitation tank 8, 15 a pit arranged near the inlet of the gate 14 to receive the overflowing slag, 16 a feed pipe line for supplying the cooling water from the pump 6 to the inlet ports 11' of the respective trough elements, and 17 an exhaust pipe line for collecting the cooling water from the exhaust ports 11 of the trough elements and directing the cooling water to the cooling tower 5. The gate 14 may be of a hollow water-cooled structure made of refractory material or copper or copper alloy, and the overflow pit 15 is provided to store the overflowing molten slag upstream of the gate 14 without any leakage to the outside and also to meet the situation in which the flow rate of the slag is low during the initial period of the tapping from the blast furnace but the flow rate increases greatly with time.

The stream of molten metal flowing from the tapping hole of the blast furnace 1 is separated into molten iron and molten slag by the skimmer 2 and thus the molten iron flows downward through the molten iron runner 3 into a ladle or the like which is not shown. The molten slag flows downward through the molten slag runner 7 and through the gate 14 into the agitation tank 8 of the water granulating plant while being cooled by the water-cooled trough elements 10. The supply of cooling water to the trough elements 10 is effected from the bottom water collecting pit 4 through the pump 6 and the feed pipe line 16, and the used water is delivered from the elements 10 through the exhaust pipe line 17 and sprinkled into the cooling tower 5 from which the used water is returned to the water collecting pit 4 for recirculation.

Figure 4:
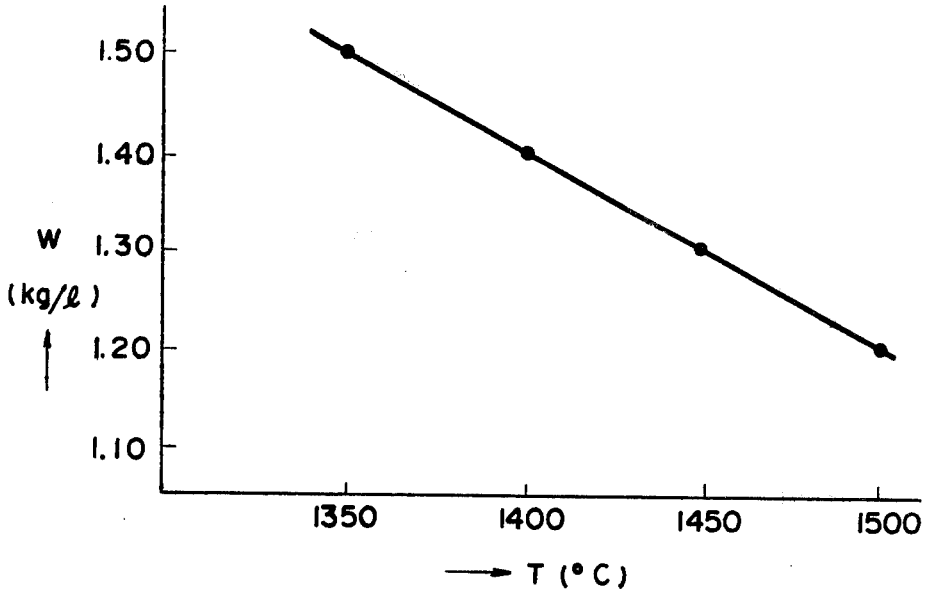
FIG. 4 is a graph showing the relationship between the weight W per unit volume of the granulated slag produced by water jet granulation (plotted on the ordinate in Kg/l) and the temperature T of the raw material molten slag (plotted on the abscissa in degrees centigrade).

FIG. 4 is a graph showing the relationship between the temperature of raw material molten slag and the weight per unit volume of granulated slag produced from the material in the production of granulated slag. As shown in the Figure, it is essential to decrease the temperature of the raw material molten slag for the production of hard granulated slag having a large weight per unit volume.

With the molten slag runner of the invention which is composed of water-cooled trough elements, by selecting the flow velocity and water pressure of the cooling water in the trough elements about 3 m/sec and 3 Kg/cm$^2$, *respectively, a stream of molten slag having a temperature of about* 1,500° C. and flowing at the flow rate of 2 to 3 ton/min can be cooled with the resulting temperature drop of about 2° C. to 4° C. per meter of the length of the slag runner while effectively preventing melting loss of the trough elements, and not only the temperature drop can be controlled with a satisfactory response by controlling the water supply system, that is, by controlling the flow velocity of the cooling water, for example, but also this forced cooling has the effect of decreasing the wear of the trough elements or the runner to less than one tenth of that of the runner composed of a refractory trough and also reducing by half the amount of molten slag which stickes to the elements.

For example, by connecting in series 80 water-cooled trough elements each having a length of 500 mm into a molten slag runner having a total length of 40 m, and selecting the amount of cooling water supply per trough element 0.2 ton/min, the slag temperature drop per element 3° C., the specific heat of the molten slag 0.28 Kcal/Kg.°C. and the flow rate of the molten slag 2.0 ton/min, the total temperature drop of the molten slag passing through the entire length of the molten slag runner is given by $$(0.2 \cdot 3.0 \cdot 80/0.28 \cdot 2.0) = 85.7° \text{ C.}$$

Thus, molten slag of 1,500° C. will be cooled to about 1,414° C. by the time it reaches the end of the slag runner thus ensuring the production of water granulated slag having a weight per unit volume of over 1.3 Kg/l as will be seen from FIG. 4, and it is still possible to produce granulated slag of the order of 1.5 Kg/l by increasing the amount of cooling water supply.

Figure 5:
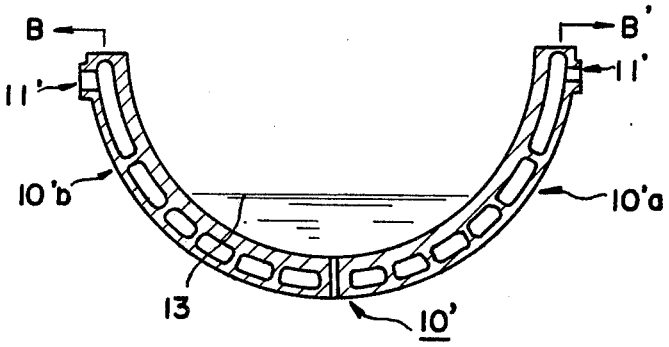
FIG. 5 is a cross-sectional view showing a trough element according to another embodiment of the invention.
Figure 6:
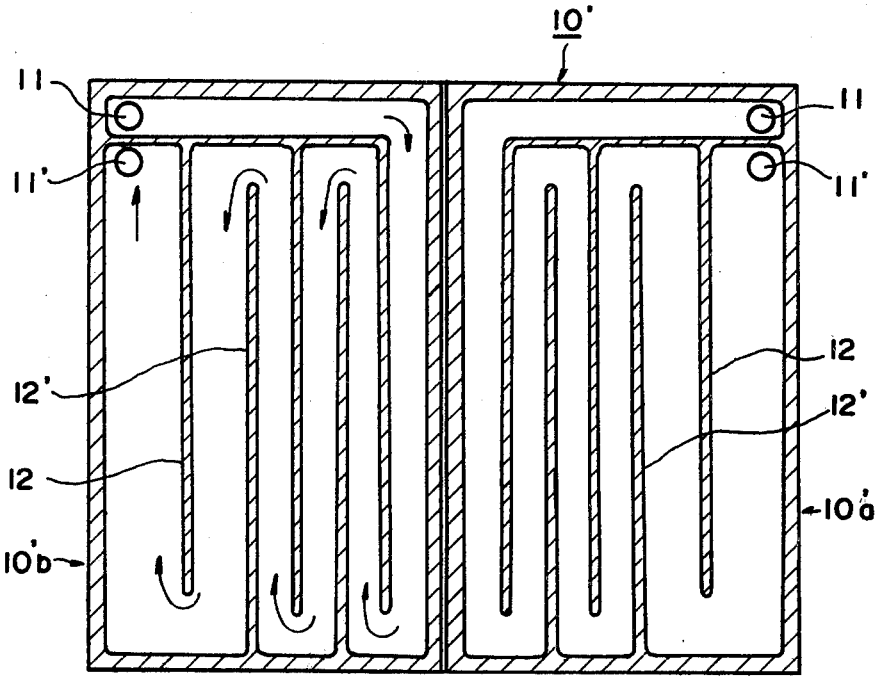
FIG. 6 is a developed sectional view of the trough element seen in the direction of the arrow B–B' of FIG. 5.

FIGS. 5 and 6 show a trough element for slag runner according to another embodiment of the invention. In the Figure, numerals 10'*a* and 10*40 b* designate a pair of symmetrical hollow bodies each of which is made of copper or copper alloy and near quarter circular in cross-sectional shape, and the bodies 10'*a* and 10'*b* are assembled into a trough element 10'. Each of the hollow bodies 10'*a* and 10'*b* constituting the two-part trough element 10' is provided in one upper side edge portion with an exhaust port 11 and an inlet port 11', and partitions 12 and 12' divide the space within the body into a series of zigzag passages which extend parallel with the direction of flow of molten slag. In this case, the partitions 12 and 12' are arranged alternately and they are also disposed so that the spacing between the partitions is decreased as they are located nearer to the runner bottom or more remote from the exhaust and inlet ports and the cross-sectional areas of the cooling water passages defined therebetween are successively decreased, thus increasing the flow velocity of the cooling water without any stagnation in those portions corresponding to the runner bottom which is subject to a severe heat load. On the other hand, the passages located closer to the side including the exhaust and inlet ports have greater cross-sectional areas so as to reduce the pressure loss of the cooling water. The coupling structure of the hollow bodies 10'*a* and 10'*b* should preferably be such that they are fitted together to form a joint which extends along the direction of flow of molten slag so as not to provide any flow resistance to the flow of molten slag. With this two-part trough element, when melting loss of the trough element is caused, the replacement of only one of the bodies will be sufficient in many cases with the resulting reduction in the unit equipment cost.

Figure 7:
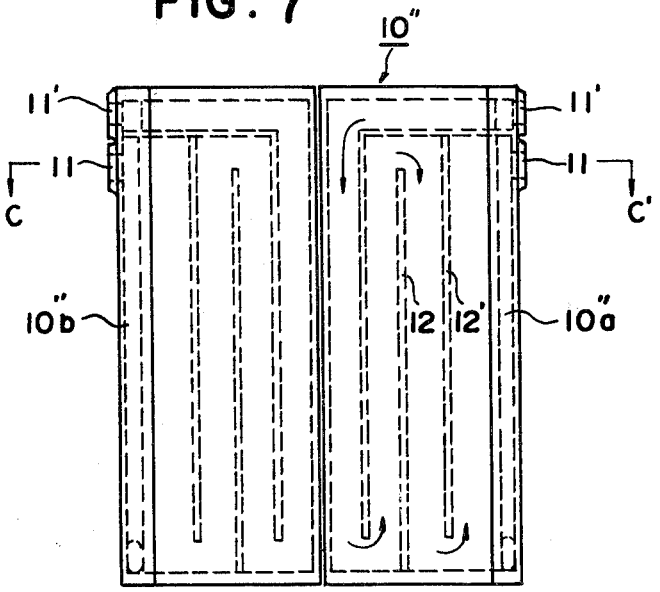
FIG. 7 is a plan view of a trough element according to still another embodiment of the invention.
Figure 8:
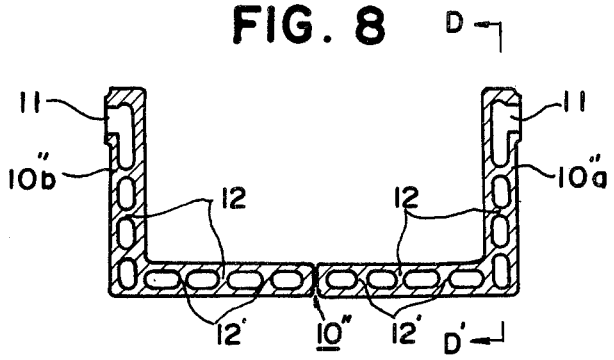
FIG. 8 is a cross-sectional view of the trough element seen in the direction of the arrow C–C' of FIG. 7.
Figure 9:
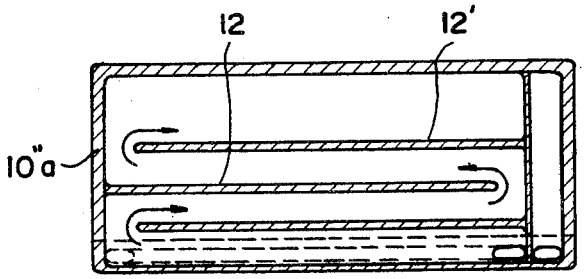
FIG. 9 is a longitudinal sectional view of the trough element seen in the direction of the arrow D–D' of FIG. 8.

FIGS. 7, 8 and 9 show a trough element for molten slag runner according to still another embodiment of the invention. In the Figures, numerals 10''*a* and 10''*b* designate a pair of symmetrical hollow bodies each of which is made of copper or copper alloy and L-shaped in cross section, and the hollow bodies 10''*a* and 10''*b* are put together to form a trough element 10'' as shown in FIGS. 7 and 8. Each of the hollow bodies includes an exhaust port 11 and an inlet port 11' which are provided in the upper portion of its raised side wall, and disposed in the space within the body are a plurality of partitions 12 and 12' which are arranged alternately to extend parallel with the direction of flow of molten slag and thereby to define a series of zigzag cooling water passages within the body. As in the case of the embodiment shown in FIGS. 5 and 6, the spacing of the partitions is decreased in the trough bottom portion which is subject to a severe heat load and the spacing is increased in the upper side wall portions so as to reduce the pressure loss of the cooling water. With this trough element having a rectangular shape in cross-section, as compared with the trough element having a circular cross-sectional shape, the contact area with molten slag is increased and consequently the cooling efficiency is increased comparatively.

It will thus be seen from the foregoing description that in accordance with the present invention a molten slag runner comprises a plurality of water cooled trough elements each composed of a hollow body which is made of copper or copper alloy and having a series of zigzag cooling water passages formed within the body by a plurality of partitions, and there are thus the advantages of reduced wear and damage to the molten slag runner by the molten slag stream, great reduction in the amount of refractory material used, effectively preventing the molten slag from sticking to the surface of the trough by virtue of the forced cooling of the trough, easy repair work in a short period of time by virtue of the replaceable trough elements, and effectively cooling the molten slag to the desired temperature thus making it possible to easily produce hard granulated slag.

It should be apparent to those skilled in the art that molten slag runners incorporating water-cooled trough elements of the type described throughout the length of the runners as well as molten slag runners incorporating such trough elements only in some portions such as the bent portions or the ends of the runners equally come within the scope of the molten slag runner of this invention. Further, while, in the embodiments described above, molten slag is granulated by water jet granulation, the temperature control is an important factor for improving the physical properties of the granulated slag produced by the water pit granulation or dry granulation, air cooled slag, etc., and therefore the present invention is not intended to be limited to any manner of solidifying the molten slag discharged through the molten slag runner of this invention.

We claim:

1. In a molten slag runner for conducting a stream of molten slag from a blast furnace to another place, the improvement wherein:

(a) at least part of said runner is composed of a plurality of trough elements arranged in series and subjected to forced cooling;

(b) each of said trough elements comprises a hollow body made of copper or copper alloy; and (c) said hollow body comprises a plurality of partition walls alternately arranged parallel to one another to define throughout a space within said hollow body a series of zigzag passages disposed to flow a cooling medium without stagnation, wherein the spacing of said partition walls in the lower portion of said trough element is smaller than that of said partition walls in the upper portion of said trough element and inlet port means and exhaust port means connecting the ends of said series of passages to external cooling medium supply and exhaust pipe means.

2. A molten slag runner according to claim 1, wherein a gate including an outlet having a predetermined opening area is disposed upstream of said trough elements.

3. A molten slag runner according to claim 1, wherein said plurality of partition walls are alternately arranged parallel to one another in a direction normal to the lengthwise direction of said trough element, whereby said passages are provided in the form of a series of zigzag passages including parallel portions which are bent in the upper side portions of said trough element and normal to the lengthwise direction of said trough element, and one edge of said partition walls exposed to said passages in said bent passage portions is located above the surface of a molten slag stream in said trough element.

4. A molten slag runner according to claim 1, wherein said hollow body is a two-part structure joined by a joint extended along the lengthwise direction of said trough element.

* * * * *